United States Patent [19]

Hall

[11] 4,115,934

[45] Sep. 26, 1978

[54] LIQUID SHOE INNERSOLE

[76] Inventor: John M. Hall, 783 Moreno Dr., Oaji, Calif. 93023

[21] Appl. No.: 767,759

[22] Filed: Feb. 11, 1977

[51] Int. Cl.[2] ..... A43B 13/38

[52] U.S. Cl. ..... 36/44; 36/29

[58] Field of Search ..... 36/44, 29

[56] References Cited

U.S. PATENT DOCUMENTS

| | | | |
|---|---|---|---|
| 2,004,906 | 6/1935 | Simister | 36/29 |
| 2,393,577 | 1/1946 | Urbany | 36/29 |
| 3,724,106 | 4/1973 | Magidson | 36/44 |
| 3,795,994 | 3/1974 | Ava | 36/29 |
| 3,922,801 | 12/1975 | Zente | 36/44 |

FOREIGN PATENT DOCUMENTS

| | | | |
|---|---|---|---|
| 1,332,892 | 6/1963 | France | 36/29 |
| 856,622 | 12/1960 | United Kingdom | 36/44 |

*Primary Examiner*—Alfred R. Guest

*Attorney, Agent, or Firm*—Jack C. Munro

[57] ABSTRACT

An innersole for shoes formed of a plastic material having an interior fluid tight main chamber, a quantity of liquid to be placed within the main chamber with the innersole being permanently sealed to prevent leakage of the liquid exteriorly of the innersole, the innersole having a sealed peripheral edge to contain the liquid, the innersole including totally enclosed liquid containing second chambers, the second chambers having a sealed periphery within said main chamber.

3 Claims, 4 Drawing Figures

LIQUID SHOE INNERSOLE

BACKGROUND OF THE INVENTION

People that are on their feet for a substantial period of time during the day frequently incur person's feet becoming sore with the feet swelling. In order to make a person's feet more comfortable, it is well known to employ the use of some soft resilient rubber pads as innersoles. Although such a pad does provide temporary comfort to some extent, certain portions of the pad become permanently compressed in time to where the resiliency of the pad is lost. At this point, the effect of such a pad has now been negated.

It has been considered feasible previously to employ a fluid within a person's show in order to make the walking and standing of the person more comfortable. There has been known attempts to employ fluid in a removable innersole but it has been very difficult in the past to direct and contain the fluid in the areas of the feet where a major portion of a person's weight is applied. Previous to this invention, any attempt to specifically locate liquid in the main areas of weight would almost surely cause immediate rupture of the innersole.

SUMMARY OF THE INVENTION

The apparatus of this invention relates to a plastic innersole having an interior main chamber which is adapted to contain a quantity of liquid. The innersole is to be permanently sealed around the edges thereof to prevent leakage of the liquid from the main chamber. Within the main chamber are to be located a plurality of totally enclosed second chambers. Each of these second chambers is to include a quantity of liquid and communication of the liquid within the second chamber to the main chamber is prevented. Each of the second chambers is totally sealed with respect to the main chamber. The second chambers are to be located within the innersole at areas of maximum weight, such as in the heel area and in the ball of the foot.

DETAILED DESCRIPTION OF THE SHOWN EMBODIMENT

Figure 1:
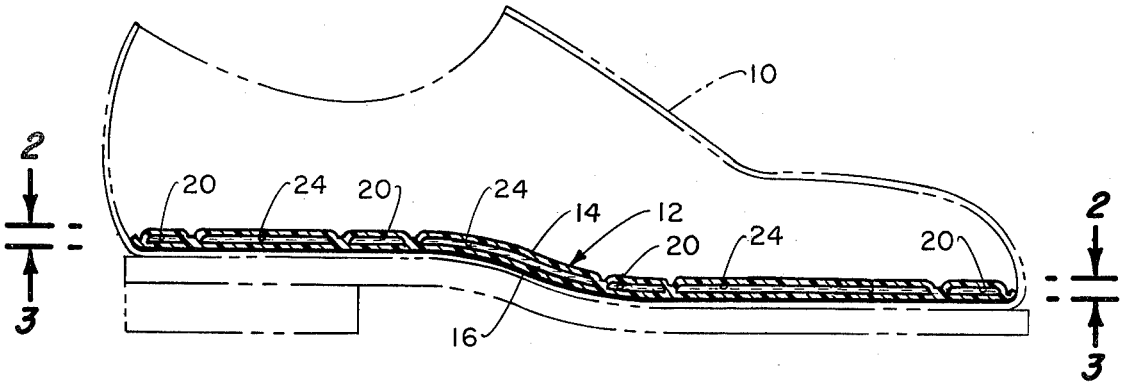
FIG. 1 is a side view showing how the innersole of this invention would be installed within a conventional shoe.

Referring particularly to FIG. 1, there is shown a conventional shoe 10 which has the innersole 12 of this invention supported therein. The innersole of this invention is constructed of an upper layer 14 of material and a bottom layer of material 16. The bottom layer of material 16 is permanently fixed to the upper layer 14 around the periphery thereof to form an edge 18. The type of material for the innersole 12 is to be a plastic material. However, it is considered to be within the scope of this invention that other types of materials could be employed.

Figure 2:
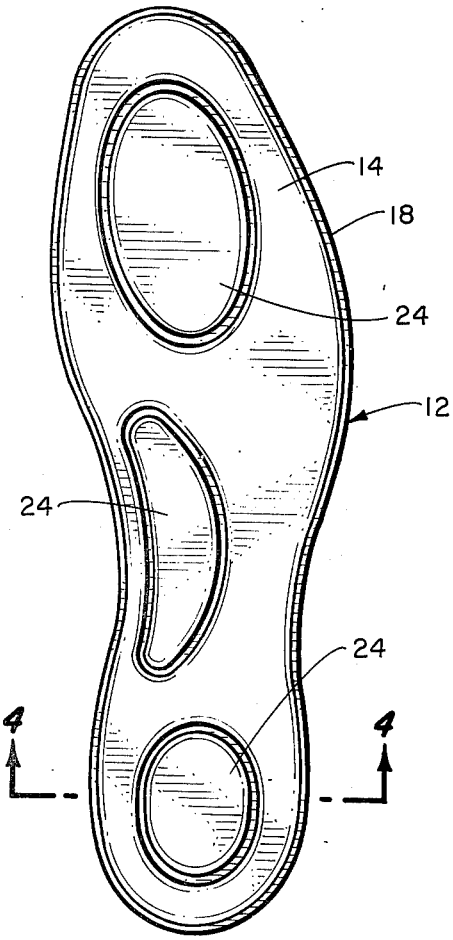
FIG. 2 is a plan view of the innersole of this invention taken along line 2—2 of FIG. 1.
Figure 3:
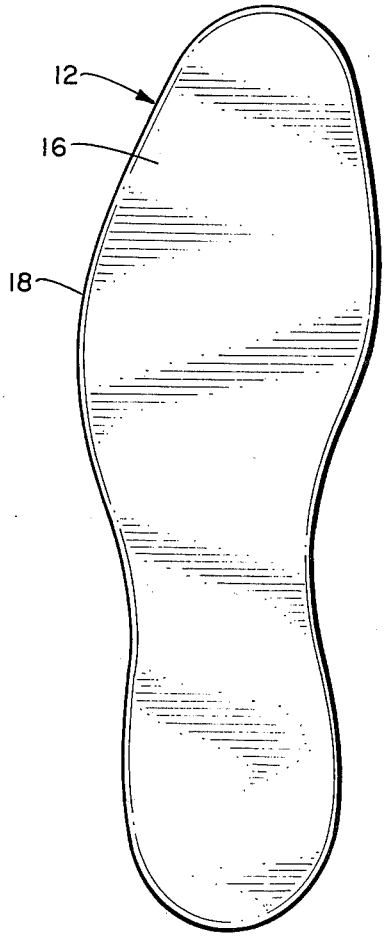
FIG. 3 is a bottom view of the innersole of this invention taken along line 3—3 of FIG. 1.
Figure 4:
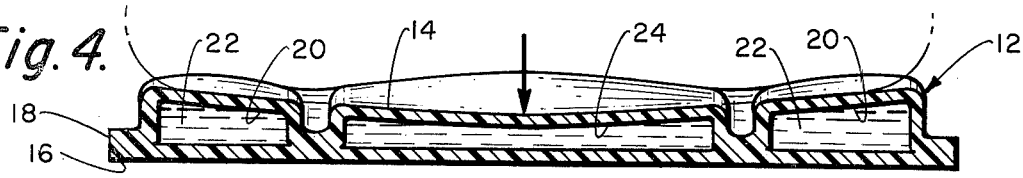
FIG. 4 is a cross-sectional view of the innersole of this invention taken along line 4—4 of FIG. 2.

It is to be noted, referring to FIG. 2 of the drawing, the innersole 12 of this invention is shaped in the basic design of a person's foot. This is desired in order to facilitate location of such within the show 10.

Formed between the upper layer 14 and the lower layer 16 is an enlarged main chamber 20. Within the chamber 20 is to be located a liquid 22. The normal type of liquid will in all probability be some form of a gel. However, it is considered to be within the scope of this invention that other types of liquid could be employed, such as water compositions, or alcohol compositions.

It is to be noted, that as a person walks, a person's weight is applied first to the heel and then as the person moves forward, the weight is transferred to the ball of the foot. If just the main chamber 20 was employed, once the weight was first applied to the heel, the liquid 22, which provides the desired cushioning effect, immediately rushes from the area of the heel to the ball section of the innersole. This means that in effect there is little or no cushioning effect.

As the person then applies their weight to the ball of the foot, the same procedure occurs with the liquid rushing from the ball of the foot to the heel area of the innersole. A certain amount of this liquid movement within the innersole is desirable as it does provide a "massaging" effect. However, complete liquid elimination, is undesirable.

Previously, in the constructing of such innersoles, it has been found a manufacture impossibility to construct a totally enclosed chamber area within the main liquid receiving chamber. This procedure has been difficult in the past because, with the liquid already contained in the main chamber, it has not been possible to compress and seal the layers 14 and 16 and form a substantially leakage free seal since the liquid functions as a cooling medium.

The present invention has overcome this difficulty and is capable of forming totally enclosed second chambers 24. The totally enclosed second chambers 24 can be either basically ellipsoidal in shape or could be circular or any other configuration that is desired. It is to be noted that there is a second section 24 located at the ball section of the innersole and a second section 24 located in the heel area of the innersole. There is also a section 24 located in the area of the shank. This means that whatever the weight distribution of the person's feet is, there will always be liquid under the person's feet no matter what the position of the person's feet.

The innersole 12 of this invention will normally be constructed in various sizes. A given size of innersole will be adapted to fit a plurality of different shoe sizes (such as three different sizes).

What is claimed is:

1. An innersole adapted to be placed within a shoe, said innersole comprising:

an upper layer of material and a lower layer of material being connected together forming a permanent first seal at the peripheral edges forming an interior main chamber, said interior main chamber extending throughout the length of the insole a liquid within said main chamber, said upper layer of material and said lower layer of material being constructed of a flexible plastic material; and a second chamber surrounded by within said main chamber and in the plane thereof, the peripheral edge of said second chamber being formed by the connecting together of said upper and said lower layers of material to form a permanent second seal, the plane of said second seal being within the plane of said first seal, said second seal being formed with liquid being located within said main chamber, leakage of said liquid being prevented between said main chamber and said second chamber.

2. The innersole as defined in claim 1 wherein:

there being a plurality of second chambers with one located in the forward portion of said innersole and another second chamber located in the rearward portion of said innersole.

3. The innersole as defined in claim 2 wherein:

therebeing an additional said second chamber located within the shank section of said innersole.

* * * * *